United States Patent [19]

Stachiw et al.

[11] 3,999,879

[45] Dec. 28, 1976

[54] INFLATABLE ROADWAY

[75] Inventors: Jerry D. Stachiw, Lakeside; Joseph B. Berkeley, Jr., San Diego, both of Calif.

[73] Assignee: The United States of America as represented by the Secretary of the Navy, Washington, D.C.

[22] Filed: June 16, 1975

[21] Appl. No.: 587,515

[52] U.S. Cl. ..... 404/73; 404/35; 14/27

[51] Int. Cl.[2] ..... E01C 5/00

[58] Field of Search ..... 404/35, 1, 73; 14/27, 14/1; 5/349, 350, 365; 214/152, 1 BE; 180/125

[56] References Cited

UNITED STATES PATENTS

| | | | |
|---|---|---|---|
| 1,746,709 | 2/1930 | Marshall | 5/349 |
| 2,342,773 | 2/1944 | Wellman | 404/35 X |
| 2,987,024 | 6/1961 | Rush | 14/27 X |
| 3,008,213 | 11/1961 | Foster | 5/350 X |
| 3,258,800 | 7/1966 | Robinsky | 14/27 |
| 3,282,359 | 11/1966 | Satterfield | 214/1 BE X |
| 3,399,407 | 9/1968 | Olsen | 5/350 X |
| 3,458,884 | 8/1969 | Gurganious | 14/27 |
| 3,466,685 | 9/1969 | Robinsky | 14/27 |
| 3,496,586 | 2/1970 | Kaufman | 14/27 |
| 3,511,039 | 5/1970 | Gould | 5/365 X |
| 3,583,008 | 6/1971 | Edwards | 5/349 |
| 3,772,717 | 11/1973 | Yuen et al. | 5/349 |
| 3,826,329 | 7/1974 | Crimmins | 214/1 BE X |
| 3,834,556 | 9/1974 | Crimmins | 214/1 BE |

*Primary Examiner*—Nile C. Byers, Jr.
*Attorney, Agent, or Firm*—Richard S. Sciascia; Ervin F. Johnston; Thomas Glenn Keough

[57] ABSTRACT

An inflatable roadway includes elongate flexible upper and lower panels secured and sealed together about their peripheries. The roadway is stored and transported in a laterally rolled configuration and when it is placed on the near side of an area of unfirm terrain, it is immediately ready for deployment. Coupling a source of pressurized gas to an appropriately disposed fitting on the roadway inflates at least one longitudinal envelope to cause an unrolling of the roadway across the unfirm area. A multitude of strands extending between the upper and lower panels ensures that the exposed surface of the upper panel maintains an essentially flat configuration. Personnel and vehicles can safely traverse a body of water, thin ice, swamp or similar unfirm areas, safely. An air bearing cargo transportor also can traverse the unfirm terrain since the strands ensure that a smooth upper exposed surface is presented for pneumatic cooperation with the air bearing.

8 Claims, 5 Drawing Figures

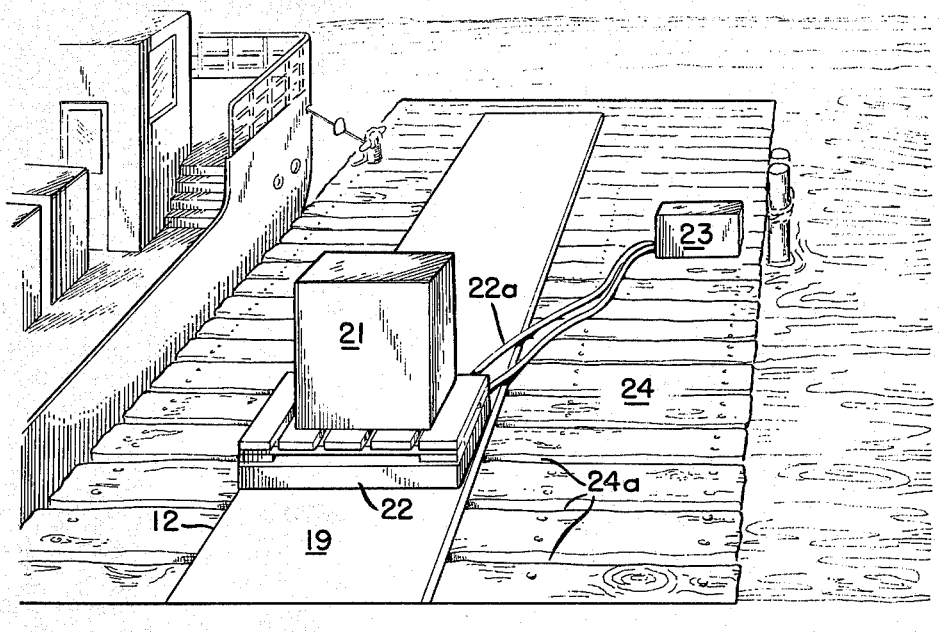
FIG. 3
FIG. 4
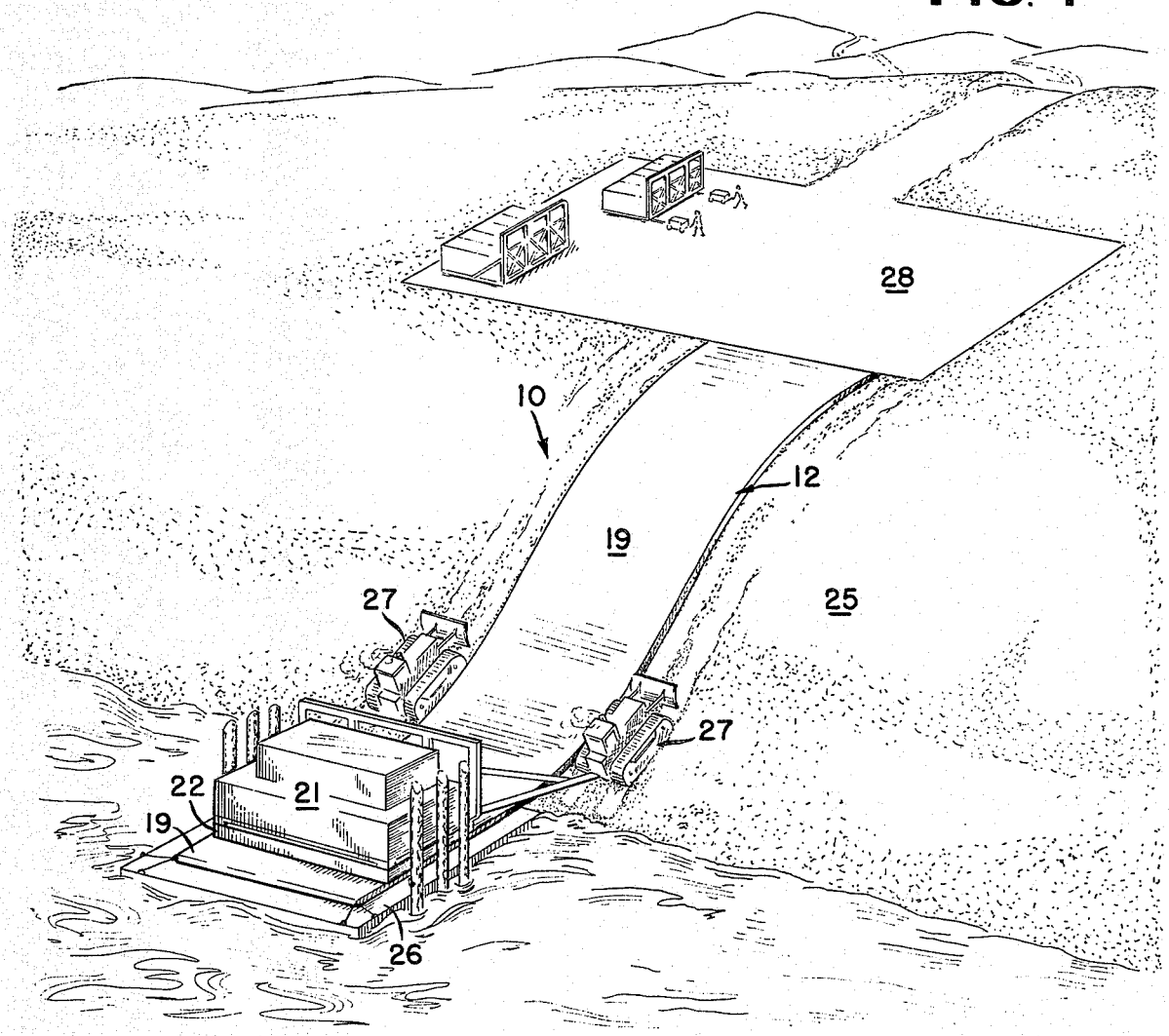

INFLATABLE ROADWAY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

A variety of techniques are currently in use for permitting passage across sand, swamps, water, thin ice, snow, or other areas where the terrain is of unfirm or hazardous nature. A well-known approach is to place steel or aluminum interlocking planks over the soft terrain to distribute the bearing pressure over a wide area and thereby allow the traverse of men and equipment. Bridging water usually calls for interconnecting sections of a pontoon bridge and pushing them out across the water obstacle. Both of these approaches present a formidable logistical effort and are time consuming. In a situation where the bridging crews are exposed to hostile fire, the necessary exposure of personnel often results in unacceptable casualties. Assault groups cannot take the time nor have the logistics capability in a rapidly moving combat operation. There is a continuing need in the state of the art for a rapidly erectable, lightweight device for allowing the transport of men and equipment across water, swamps, thin ice or similar natural obstacles. In a more friendly atmosphere there is also a continuing need for a rapidly deployable roadway permitting the off-loading of cargo across an irregular surface such as a dock or a sandy soft beach which does not itself create a formidable logistics problem.

SUMMARY OF THE INVENTION

The present invention is directed to providing an inflatable roadway for bridging an unfirm foundation. A first elongate panel and a second elongate panel are bonded together around their peripheries and are flexible enough to be stored in a laterally rolled configuration. A gas fitting is coupled to a source of pressurized gas and the roadway is unrolled as pressurized gas fills at least one longitudinal envelope defined between the two panels. A multitude of strands extend between the two panels to ensure the creation of a smooth, exposed surface for pneumatically cooperating with a cargo laden air bearing.

It is a prime object of the invention to provide a rapidly deployable roadway.

Another object is to provide a rapidly deployable roadway which is lightweight.

Yet another object is to provide an inflatable roadway suitable for deployment under combat conditions.

Still another object is to provide an inflatable roadway which neutralizes the adverse effects of unfirm terrain.

Still another object is to provide an inflatable roadway that is deployed as it unrolls across an area of unfirm terrain.

Still another object is to provide an inflatable roadway which ensures the creation of an even exposed surface.

Yet another object is to provide a method for deploying an inflatable roadway to ensure the transfer of heavy cargo loads.

Still another object is to provide a method for ensuring the creation of a smooth exposed surface for pneumatic cooperation with a cargo laden air bearing.

These and other objects of the invention will become more readily apparent from the ensuing description when taken together with the drawings.

BRIEF DESCRIPTION OF THE DRAWINGS

FIG. 3 is an isometric depiction of the invention used as a bearing surface for an air bearing.

FIG. 4 shows another use of the inflatable roadway providing the bearing surface for an air bearing.

DESCRIPTION OF THE PREFERRED EMBODIMENTS

Figure 1:
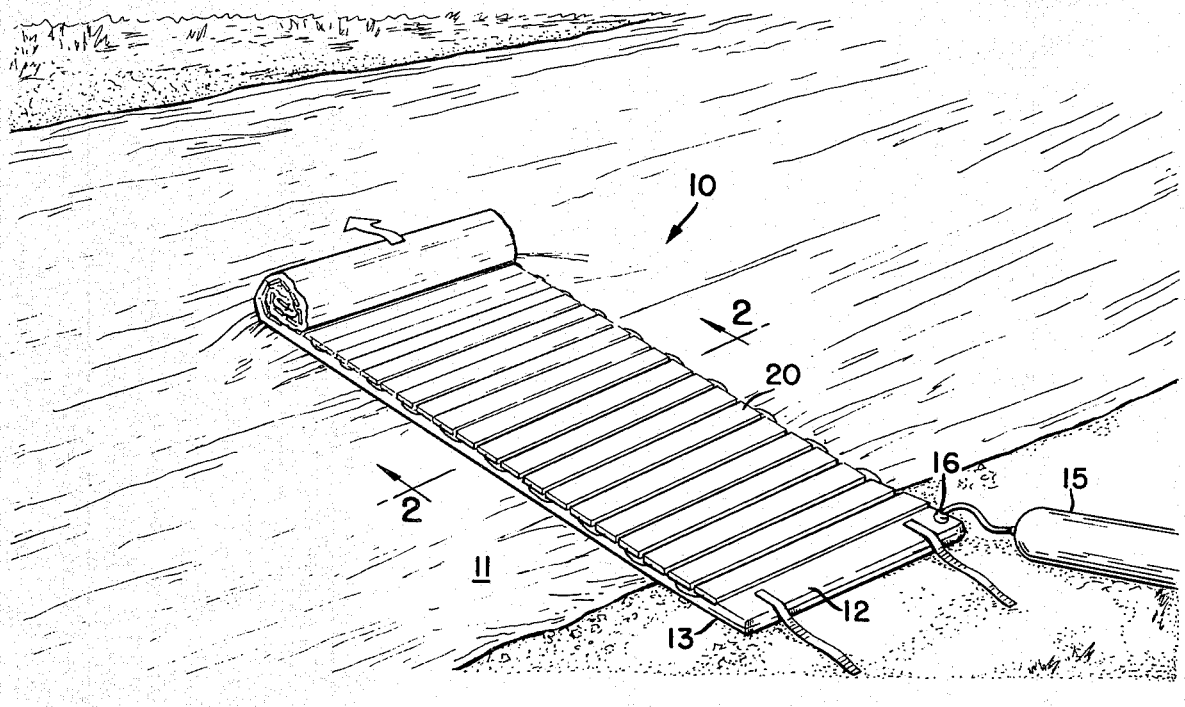
FIG. 1 is an isometric depiction of one embodiment of the invention being deployed.
Figure 2:
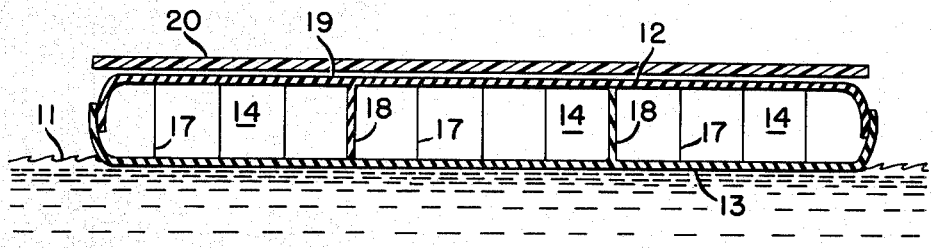
FIG. 2 is a cross-sectional view of the inflatable roadway taken generally along lines 2—2 in FIG. 1.
Figure 5:
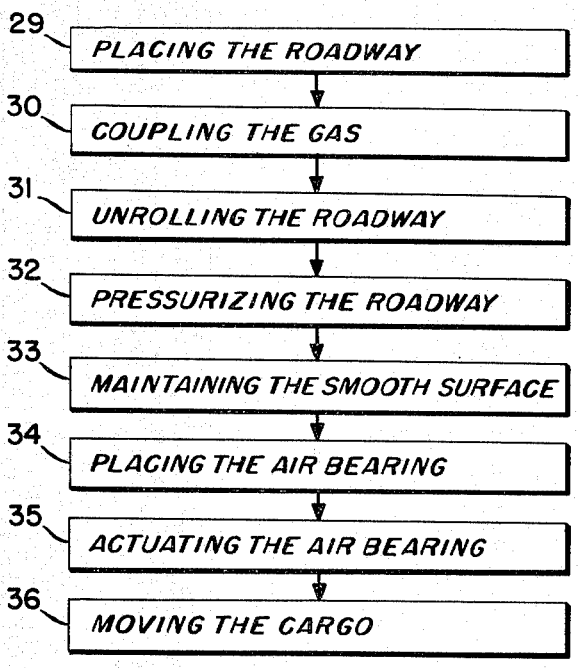
FIG. 5 schematically depicts the method of the invention.

Referring now to the drawings, a representative embodiment of an inflatable roadway 10 is depicted as it is bridging an area of unfirm terrain 11. In this particular demonstration the generically referred to area of unfirm terrain is water. Swamps, ice, snow, slush, sand, aggregate and other similar areas in the topography are equally bridged with ease by the present invention. Beaches which are a combination of being soft and irregular also present no obstacles for personnel, equipment and cargo as will be explained below. The only applications where the invention has been found to be somewhat lacking are in bridging volcanoes, lion cages, and racially troubled areas, for example.

The main constituent parts of the invention are an elongate upper panel 12 and an elongate lower panel 13. Both of the panels are fashioned from a heavy duty flexible material such as a rubber impregnated canvas having a flexibility which allows their being stored and transported in a laterally rolled configuration. The panels are secured to one another around their peripheries by a variety of techniques well known in the art. In one preferred embodiment the peripheries were bonded with a commercial adhesive and sewn together create a tough enough joint to contain pressurized gas in a longitudinal envelope or chamber 14.

The longitudinal chamber is distended to its full dimension when a pressurized gas source 15 is coupled to a fitting 16 which communicates with the envelope. Although a tank of compressed air is shown in the drawings, it is understood that an air compressor or chemical gas generator optionally is substituted.

As more and more of the gas is fed to the chamber, the rolled-up upper and lower panels 12 and 13 automatically unroll in a direction away from the pressurized gas source. The unrolling deploys the roadway across water, sand, thin ice or other unfirm area. It should be noted that the automatic deployment of the roadway does not call for the undue exposure of personnel. This feature, along with the portability of the roadway, makes it highly suitable for use by assault teams under combat conditions.

After the panels are unrolled completely, an additional volume of gas is fed into the longitudinal envelope. A multitude of strands 17 are connected at their opposite ends to the upper and lower panels and ensure that the longitudinal envelope has a uniform rectangular, cross-sectional shape. Optionally, several equidistantly spaced partitioning walls 18 run the length of the inflatable roadway and to aid in restricting the width of the chamber. The walls are fabricated from a flexible fabriclike material so as not to interfere with the rolling and unrolling of the roadway. A combination of strands and walls also can be used, their main function is to hold elongate upper panel 12 so that it defines a smooth outer surface 19. This smooth upper surface is essential for pneumatic cooperation with an air bearing 22 as will be explained below.

When the inflatable roadway is used by a mobil assault group, decking panels 20 usually are provided to protect the upper surface. These decking panels preferably are some lightweight rugged material such as plastic, aluminum or wood which additionally more evenly distribute the load across the roadway. The decking panels are dimensioned so as not to overly interfere with storing and carrying the roadway in its rolled configuration. The panels do not prevent the auotmatic unrolling of the roadway.

When, however, the roadway is chosen to function as a smooth bearing surface of an air bearing, it greatly increases the capabilities and the applications of an air bearing. Air bearings are widely used to transfer heavy cargo loads usually in a loading area or within warehouses. Most of them function on the principle that when a sufficient volume of pressurized air is blown through venteral ducts and under a peripheral skirt, a relatively heavy load is borne by a cushion of air. This air cushion is relatively frictionless and little effort is needed to move the load from one place to another.

A limitation inherent in the use of air bearings is that they must pneumatically react with a smooth surface. Consequently, their use has been somewhat restricted to areas having relatively smooth floors or slabs.

The present invention greatly increases the areas where air bearings are employed by providing the needed smooth surface. Noting FIG. 3, a load of heavy cargo 21 is being transported across a dock 24 having a standard slotted decking 24*a*. The slots between adjacent planks are universally employed for drainage and to help reduce the weight of the dock. As a consequence, air bearings have been considered generally unsuitable for the unloading of the heavy containers used in marine shipping. Deploying the inflatable roadway as described above bridges the slots and an air bearing now can be used to off load a ship. In this application, however, decking sections 20 are not included.

Cargo 21 is located on a palate supported by an air bearing 22. A hose 22*a* feed substantial volumes of compressed air from a compressor 23 to the bearing and the cargo is supported on a cushion of air. A small force moves the heavy cargo the length of the inflatable roadway. Several roadways can be interconnected at their opposite ends to provide a passageway from a ship to a warehouse.

Another application of the instant invention which speeds up the off-loading time of heavy cargo is shown in FIG. 4. A modified inflatable roadway 10 is deployed as described across a sandy beach. The modifications are with respect to being built larger and of more rugged materials to accommodate extremely heavy loads. Otherwise, roadway is essentially the same as the previously described.

A smooth exposed surface 19 of elongate upper panel 12 provides a proper surface over a sandy beach 25. One section of inflatable roadway is placed on a lighter barge 26 before cargo module 21 and air bearing 22 are unloaded from a ship. The lighter barge closely approaches the sandy beach and the inflatable roadways on the lighter barge and on the beach are inflated. A pressurized gas source, not shown, activates air bearing 22 and a pair of tractors 27 pulls the cargo module to an unloading area 28. In the unloading area or storage yard the cargo module is unpacked and distribued.

By reason of the functionally cooperating structure described hereinbefore a novel method for expediting a cargo transfer has been created. First, there is a placing 29 of the roadway on the near side of an unfirm area such as sand, water, swamp, etc. Next, there follows a coupling 30 of a source of pressurized gas to the roadway and an unrolling 31 of the roadway as pressurized gas fills a longitudinal envelope or chamber contained within. Further pressurizing 32 the roadway distends the longitudinal envelope so that there is a maintaining 33 of a smooth, exposed upper surface. A placing 34 of an air bearing on the smooth outer surface and an actuating 35 of the air bearing by its interconnection to a compressor allows the moving 36 of the cargo the length of the inflatable roadway within minimum effort.

Obviously, many modifications and variations are possible in the light of the above teachings, and, it is therefore understood that the invention may be practiced otherwise than as specifically described.

What is claimed is:

1. An inflatable apparatus for providing a roadway over an unfirm foundation comprising:

means for defining a first elongate panel having an exposed surface and a second elongate panel each having substantially the same dimensions and being secured together around their periphery to form at least one elongate longitudinal envelope, the defining means having a flexibility to allow its being stored and transported in a laterally rolled configuration;

means in the form of a fitting coupled to the defining means for fluidly communicating with the longitudinal envelope;

means connected to the fluidly communicating means for filling the longitudinal envelope with pressurized fluid thereby extending the flexible defining means from the laterally rolled configuration to an elongate roadway configuration; and a multitude of strands spaced apart from one another and anchored at opposite ends on the first and second panels to ensure that the longitudinal envelope is of uniform width and that the exposed surface is essentially flat.

2. An apparatus according to claim 1 further including:

means carried on the exposed surface for protecting the defining means and for distributing the load uniformly across the longitudinal envelope.

3. An apparatus according to claim 2 in which the first and second panels are fashioned from an elastomer impregnated fabric sewn and bonded together around their peripheries.

4. An apparatus according to claim 3 in which the fluidly communicating means is a gas fitting and the filling means is a container of pressurized gas, said pressurized gas extends the longitudinal envelope in a direction away from the container of pressurized gas.

5. A method of off-loading cargo across an area having an irregular surface comprising:

placing a rolled inflatable roadway on the near side of the irregularly surfaced area;

coupling a source of pressurized gas to the inflatable roadway;

unrolling the inflatable roadway across the irregularly surfaced area as pressurized gas fills it;

pressurizing the inflatable roadway further to create a smooth upper exposed surface;

placing a cargo ladened air bearing on the smooth upper exposed surface;

actuating the cargo laden air bearing; and moving the cargo laden air bearing across the smooth upper exposed surface.

6. A method according to claim 5 in which the irregular surface is a sand and aggregate mixture and the unrolling of the inflatable roadway occurs as at least one internal longitudinal envelope is distended by the pressurized gas.

7. A method according to claim 6 in which there is a maintaining of the smooth upper exposed surface by a multitude of spaced strands laterally coupled to an upper and lower elongate panel.

8. A method according to claim 7 in which the unrolling of the inflatable roadway is in a direction away from the source of pressurized gas and across the irregularly surfaced area.

* * * * *